US006935720B2

(12) United States Patent
Takahashi

(10) Patent No.: US 6,935,720 B2
(45) Date of Patent: Aug. 30, 2005

(54) LIQUID JETTING APPARATUS

(75) Inventor: Masaru Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/395,883

(22) Filed: Mar. 25, 2003

(65) Prior Publication Data

US 2003/0234829 A1 Dec. 25, 2003

(30) Foreign Application Priority Data

Mar. 25, 2002 (JP) ..... P2002-082368

(51) Int. Cl.[7] ..... B41J 2/165

(52) U.S. Cl. ..... 347/29; 347/23; 347/30; 347/33

(58) Field of Search ..... 347/22, 23, 29, 347/30, 33

(56) References Cited

U.S. PATENT DOCUMENTS 5,896,143 A * 4/1999 Matsui et al. ..... 347/24

6,036,299 A * 3/2000 Kobayashi et al. ..... 347/30

FOREIGN PATENT DOCUMENTS

| | | |
|---|---|---|
| JP | 3-248847 | 11/1991 |
| JP | 6-270417 | 9/1994 |
| JP | 6-320758 | 11/1994 |
| JP | 7-52406 | 2/1995 |
| JP | 9-123469 | 5/1997 |
| JP | 10-297001 | 11/1998 |

* cited by examiner

*Primary Examiner*—Shih-Wen Hsieh
(74) *Attorney, Agent, or Firm*—Sughrue Mion, PLLC

(57) ABSTRACT

A liquid jetting apparatus includes a liquid jetting head which ejects an liquid droplet from a nozzle thereof, a cap member, which seals a nozzle forming face of the liquid jetting head, and a suction device, which applies a negative pressure to the nozzle forming face of the liquid jetting head in a state that the nozzle forming face is sealed with the cap member so that the liquid in the liquid jetting head is discharged. A volume of the cap member is a volume of liquid sucked by the suction device in one suction operation or larger.

6 Claims, 7 Drawing Sheets

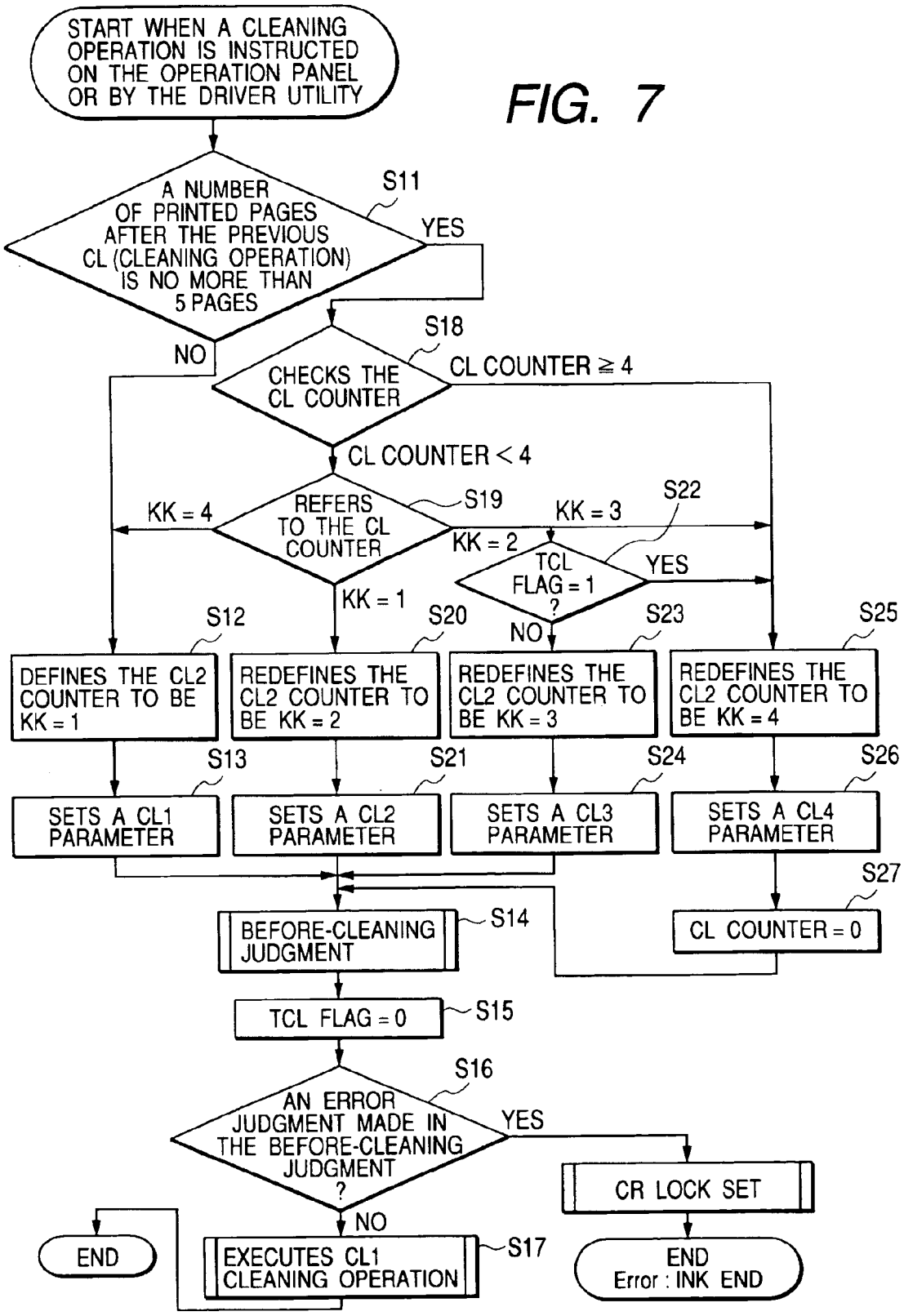
START WHEN A CLEANING OPERATION IS INSTRUCTED ON THE OPERATION PANEL OR BY THE DRIVER UTILITY
FIG. 7
A NUMBER OF PRINTED PAGES AFTER THE PREVIOUS CL (CLEANING OPERATION) IS NO MORE THAN 5 PAGES
S11
YES
NO
CHECKS THE CL COUNTER
S18
CL COUNTER ≧ 4
CL COUNTER < 4
REFERS TO THE CL COUNTER
S19
KK = 4
KK = 3
KK = 2
KK = 1
TCL FLAG = 1 ?
S22
YES
NO
S12
S20
S23
S25
DEFINES THE CL2 COUNTER TO BE KK = 1
REDEFINES THE CL2 COUNTER TO BE KK = 2
REDEFINES THE CL2 COUNTER TO BE KK = 3
REDEFINES THE CL2 COUNTER TO BE KK = 4
S13
S21
S24
S26
SETS A CL1 PARAMETER
SETS A CL2 PARAMETER
SETS A CL3 PARAMETER
SETS A CL4 PARAMETER
S27
BEFORE-CLEANING JUDGMENT
S14
CL COUNTER = 0
TCL FLAG = 0
S15
S16
AN ERROR JUDGMENT MADE IN THE BEFORE-CLEANING JUDGMENT ?
YES
NO
CR LOCK SET
END
EXECUTES CL1 CLEANING OPERATION
S17
END
Error : INK END

LIQUID JETTING APPARATUS

BACKGROUND OF THE INVENTION

The present invention relates to a liquid jetting apparatus having a capping device for sealing a nozzle forming face of a liquid jetting head.

An ink jet recording apparatus includes a recording head mounted on a carriage which is reciprocatively moved in a main scan direction, and a recording medium feeder for intermittently feeding a recording medium, such as a printing paper, every feeding quantity in a sub-scan direction. To record, the recording head ejects ink drops toward the recording medium while the recording head is moved in the main scan direction.

A mono color ink jet recording apparatus normally uses one recording head. A full color ink jet recording apparatus includes a black ink recording head for ejecting black ink, and a color recording head for ejecting color inks of yellow, cyan, magenta and the like.

A principle of causing the recording head to eject ink in the ink jet recording apparatus follows. As known, ink is pressurized at a predetermined pressure in a pressure generating chamber. On the basis of the pressure, the ink is ejected in the form of an ink drop of a controlled size toward the recording medium through each nozzle orifice in the nozzle forming face. Accordingly, an ink ejection characteristic of the ink ejection from the nozzle orifice of the recording head must be maintained invariable. If the ink ejection characteristic varies, the record quantity will be deteriorated.

The ink ejection characteristic of the recording head varies by hardening of ink in the nozzle forming face, nozzle clogging by dust attaching, air bubble entering through the nozzles and others. To cope with this, to fixedly maintain the ink ejection characteristic of the recording head, the ink jet recording apparatus includes an ejection characteristic maintaining device which eliminates factors to vary the ink ejection characteristic to thereby maintain the ink ejection characteristic of the recording head invariable.

Firstly, the ejection characteristic maintaining device usually is equipped with a capping device. In a non-recording mode, the capping device seals the nozzle forming face to isolate the nozzle orifices from exterior to thereby suppress drying of ink and hence increase of ink viscosity.

Even in a state that the nozzle forming face is sealed with the capping device, it is impossible to completely prevent the clogging of the nozzle orifices and the entering of air bubbles into the ink passages. Secondly, the ejection characteristic maintaining device is equipped with a suction device capable of causing the nozzle orifices to forcibly discharge ink therefrom by sucking in order to remove the clogging of the nozzle orifices and the air bubbles entered. The suction device applies a negative pressure to the nozzle orifices in a state that the nozzle forming face is sealed with the cap member, to thereby cause ink to be discharged, by sucking, from the nozzle orifices, whereby the clogging and air bubble entering are removed. The forcible ink sucking/discharging process carried out by the suction device is called a cleaning. Usually, the cleaning process is performed when the recording apparatus, which is not used for a long time, is operated again or when a user recognizes deterioration of a quality of a recorded picture, and operates a dedicated switch on an operation panel of the apparatus.

When the forcible ink sucking/discharging process is performed by the suction device, ink possibly scatters and attaches onto the nozzle forming face of the recording head, and the turbulence of meniscuses is caused in the nozzle orifices. Further, foreign materials tend to attach to the nozzle forming face of the recording head as time elapses. Thirdly, to cope with this, the ejection characteristic maintaining device is equipped with a wiping device for wiping the nozzle forming face as the necessity arises. The wiping device includes a wiping member formed of an elastic material of rubber, for example, and a base end of the wiping member is compressively supported with a holder. To clean the nozzle forming face, the wiping member is moved relatively to the nozzle forming face, while elastically pressing an edge of a tip part of the wiping member or its vicinal part against the nozzle forming face. The cleaning operation by the wiping member is called a "wiping operation". The "wiping operation" wipes ink and dust from the nozzle forming face, and uniformly arranges the meniscuses in the nozzle orifices, in other words, it stabilizes the meniscuses.

As described above, the capping device has two functions, a function to maintain the ink ejection characteristic by sealing the nozzle forming face, and a suction assist function to increase a negative pressure and a suction efficiency when the cleaning operation for forcibly discharging ink from the recording head is performed by the suction device in a manner that the capping device comes in close contact with the nozzle forming face. In consideration of those two functions, the capping device needs to have an area large enough to seal the nozzle forming face of the recording head. For this reason, in design the capping device, emphasis is placed on the securing of a necessary area, but little consideration is given to a volume of the cap member for the reasons given below.

When the suction operation is performed by the suction device, the ink discharged from the recording head is pulled to the suction device being under a negative pressure. Accordingly, there is no idea of securing a predetermined volume of the cap member or larger. Far from it, it is considered that if a space is present within the cap member in a state that the recording head is sealed, the nozzles will be dried. And, to reduce the size and manufacturing cost of the apparatus, attention is given to how to reduce the volume of the cap member as small as possible.

Accordingly, the volume of the related cap member is determined independently of the volume of suction ink in the suction operation, and efforts are made to reduce its size. However, where the volume of the cap member is small, a space of the cap member is filled with waste ink during the suction operation, and the waste ink sometimes reaches the nozzle forming face. If the suction device is stopped in a state that the cap member is thus filled with ink, waste ink flows back to the nozzles since the head side is under a negative pressure. As a result, dust, viscosity increased ink, air bubbles and the like enter the nozzles, and further the composite ink enters there to possibly cause color mixture. Further, when much ink attaches to the nozzle forming face, much ink is transferred to the wiper in the wiping operation, possibly causing the ink to scatter around.

Also, a technique that an ink absorbing member is put in the related cap member is used. Attempt is made, by retaining ink in the ink absorbing member, to prevent the nozzles from being dried at the time of the sealing, to suppress the suction ink from bubbling in the suction operation, and to prevent generation of ink mist in the flushing operation. Even if the ink absorbing member is put in the cap member, when the cap member is filled with ink, ink comes in contact with the nozzle forming face, and the problems stated above arise.

To cope with this, a related technique executes a fine quantity suction, which slightly operates the suction device during the first cleaning operation, several times to thereby prevent the back flow of the waste ink and the entering of air bubbles. To effect such a fine quantity suction, a dedicated sequence must be incorporated into a control sequence. Further, the cleaning time is increased by a time taken for the fine quantity suction.

SUMMARY OF THE INVENTION

It is therefore an object of the present invention to provide a liquid jetting apparatus with a capping device which is free from the back flow of waste liquid into the nozzles during the cleaning operation of the recording head, and the attaching of the liquid to the nozzle forming face.

In order to achieve the above object, according to the present invention, there is provided a liquid jetting apparatus comprising:

a jetting head, ejecting a liquid droplet from a nozzle thereof;

a cap member, sealing a nozzle forming face of the jetting head; and a suction device, applying a negative pressure to the nozzle forming face of the jetting head in a state that the nozzle forming face is sealed with the cap member so that the liquid in the jetting head is discharged, wherein a volume of the cap member is a volume of liquid sucked by the suction device in one suction operation or larger.

In the above configuration, the cap member is not filled with waste liquid in the suction operation, and the waste liquid is not attached to the nozzle forming face. That is, by determining the volume of the cap member on the basis of a suction liquid quantity, the cap member in the liquid jetting apparatus may be properly designed. For example, in the jetting head having a large number of nozzles, a suction liquid quantity is large, while in the jetting head having a small number of nozzles, a suction liquid quantity is small. There is a case that this cannot always be accurately grasped from only the area of the nozzle forming face of the jetting head. In this respect, it is reasonable to design the cap member based on the suction liquid quantity. Accordingly, the recording apparatus can solve the problem that the waste liquid flows back into the nozzles, dust, viscosity increased liquid, air bubbles and the like enter the nozzles, and the color mixture is formed by the entering of the composite liquid. Further, the liquid that attaches to the nozzle forming face is lessened in amount, and the liquid that is transferred to the wiper is extremely lessened. Additionally, there is no need of using the fine quantity suction incorporated into the cleaning operation.

Preferably, a liquid absorbing member comprised of a porous material or a nonwoven fabric is provided on the cap member In the above configuration, liquid is hard to drop out of the cap member when the cap member is opened after the suction operation. Bubbling of waste liquid is also prevented. The liquid absorbing member appropriately retains liquid. Accordingly, in a state that the nozzle forming face of the jetting head is sealed, drying of the nozzle is suppressed. At the time of flushing operation, generation of mist is suppressed, and the liquid drainage at the idle suction operation is good.

It is more preferably that, a liquid retaining capacity of the liquid absorbing member is a volume of liquid sucked by the suction device in one suction operation or larger.

In the above configuration, a liquid retaining capacity of the liquid absorbing member is a volume of liquid sucked by the suction device in one suction operation or larger. With this feature, the waste liquid in the cap member is completely absorbed in the absorbing operation.

According to the present invention, there is also provided a liquid jetting apparatus comprising:

a jetting head, ejecting a liquid droplet from a nozzle thereof;

a cap member, sealing a nozzle forming face of the jetting head; and a suction device, applying a negative pressure to the nozzle forming face of the jetting head in a state that the nozzle forming face is sealed with the cap member so that the liquid in the jetting head is discharged, wherein the suction device performs a plurality of cleaning modes which are different in a quantity of suction liquid in one suction operation; and wherein a volume of the cap member is the suction liquid volume or larger in a cleaning mode having the largest liquid suction quantity.

In the above configuration, a volume of the cap member is a suction liquid volume or larger in a cleaning mode having the largest liquid suction quantity. Therefore, the advantages of the first recording apparatus are obtained.

Preferably, the liquid absorbing member comprised of a porous material or a nonwoven fabric is provided on the cap member, and a liquid retaining capacity of the liquid absorbing member is a suction liquid volume or larger in a cleaning mode having the largest liquid suction quantity.

In the above configuration, a liquid retaining capacity of the liquid absorbing member is a suction liquid volume or larger in a cleaning mode having the largest liquid suction quantity. In addition to the advantages of the second liquid jetting apparatus, the waste liquid in the cap member is completely absorbed in the absorbing operation.

According to the present invention, there is also provided a liquid jetting apparatus comprising:

a jetting head, ejecting a liquid droplet from a nozzle thereof;

a cap member, sealing a nozzle forming face of the jetting head; and a suction device, applying a negative pressure to the nozzle forming face of the jetting head in a state that the nozzle forming face is sealed with the cap member so that the liquid in the jetting head is discharged, wherein the suction device performs a plurality of cleaning modes which are different in a quantity of suction liquid in one suction operation; and a volume of the cap member is a suction liquid volume or larger in a cleaning mode other than a cleaning mode having the largest liquid suction quantity.

In the above configuration, a volume of the cap member is a suction liquid volume or larger in a cleaning mode (for example, a cleaning mode having the second largest liquid suction quantity) other than a cleaning mode having the largest liquid suction quantity. Therefore, by excluding the use of a cleaning mode that is rarely performed, the advantages of the first recording apparatus are obtained, and there is no need of excessively increasing the size of the cap member, and a demand of apparatus size reduction is also satisfied.

That is, in the liquid jetting apparatus having a plurality of cleaning modes which are different in a quantity of liquid sucked in one suction operation, an execution frequency of the cleaning mode having the largest liquid suction quantity is usually set to be considerably lower than that of each of the remaining cleaning modes. Accordingly, the problems mentioned above can almost be solved by determining the size of the cap member on the basis of a quantity of liquid in a cleaning mode other than a cleaning mode having the largest liquid suction quantity. In this case, the problems of waste-liquid back flow, air bubble entering and others may be solved in relatively high level of solution in a manner that when the cleaning mode having the largest liquid suction quantity is performed, the fine quantity suction which is currently used is also performed. The execution of the fine quantity suction will little create a problem even if the cleaning time is long because the execution frequency of the cleaning mode per se, which has the largest liquid suction quantity, is extremely low.

Preferably, the liquid absorbing member comprised of a porous material or a nonwoven fabric is provided on the cap member, and a liquid retaining capacity of the liquid absorbing member is a suction liquid volume or larger in a cleaning mode other than a cleaning mode having the largest liquid suction quantity.

In the above configuration, a liquid retaining capacity of the liquid absorbing member is a suction liquid volume or larger in a cleaning mode other than a cleaning mode having the largest liquid suction quantity. Therefore, by excluding the use of a cleaning mode that is rarely performed, and there is no need of excessively increasing the size of the cap member, and a demand of apparatus size reduction is also satisfied.

According to the present invention, there is also provided a liquid jetting apparatus comprising:

a jetting head, ejecting a liquid droplet from a nozzle thereof;

a cap member, sealing a nozzle forming face of the jetting head; and a suction device, applying a negative pressure to the nozzle forming face of the jetting head in a state that the nozzle forming face is sealed with the cap member so that the liquid in the jetting head is discharged, wherein the suction device performs a plurality of cleaning modes which are different in a quantity of suction liquid in one suction operation; and wherein a volume of the cap member is ½ or larger of a suction liquid volume in a cleaning mode having the largest liquid suction quantity.

In the above configuration, a volume of the cap member is ½ or larger of a suction liquid volume in a cleaning mode other than a cleaning mode having the largest liquid suction quantity. Therefore, the advantages of the first recording apparatus are obtained. There is no need of excessively increasing the size of the cap member by excluding the use of a cleaning mode that is rarely performed. A demand of apparatus size reduction is satisfied. That is, in the liquid jetting apparatus having a plurality of cleaning modes which are different in a quantity of liquid sucked in one suction operation, an execution frequency of the cleaning mode having the largest liquid suction quantity is usually set to be considerably lower than that of each of the remaining cleaning modes. In many cases, a suction liquid quantity of the cleaning mode having a high execution frequency is about ½ of that in the cleaning mode having the largest liquid suction quantity. Accordingly, by determining the size of the cap member on the basis of ½ of the maximum suction liquid quantity, the cap member can cover most of the cleaning operations and the problems mentioned above can almost be solved. In this case, the problems of waste-liquid back flow, air bubble entering and others may be solved in a manner that when the cleaning mode having the largest liquid suction quantity is performed, the fine quantity suction that is conventionally used is also performed. The execution of the fine quantity suction will little create a problem even if the cleaning time is long because the execution frequency of the cleaning mode per se, which has the largest liquid suction quantity, is extremely low.

It is more preferable that, the liquid absorbing member comprised of a porous material or a nonwoven fabric is provided on the cap member, and a liquid retaining capacity of the liquid absorbing member is ½ or larger of a suction liquid volume in a cleaning mode having the largest liquid suction quantity.

In the above configuration, a liquid retaining capacity of the liquid absorbing member is ½ or larger of a suction liquid volume in a cleaning mode having the largest liquid suction quantity. Therefore, by excluding the use of a cleaning mode that is rarely performed, and there is no need of excessively increasing the size of the cap member, and a demand of apparatus size reduction is also satisfied.

BRIEF DESCRIPTION OF THE DRAWINGS

The above objects and advantages of the present invention will become more apparent by describing in detail preferred exemplary embodiments thereof with reference to the accompanying drawings, wherein:

FIG. 4 shows an enlarged view showing a cap member.

FIG. 5 shows a diagram useful in explaining a cap member with an ink absorbing member.

FIG. 7 is a flow chart exemplarily showing a cleaning operation.

DETAILED DESCRIPTION OF THE PREFERRED EMBODIMENTS

Preferred embodiments of the present invention will be described with reference to the accompanying drawings.

Figure 1:
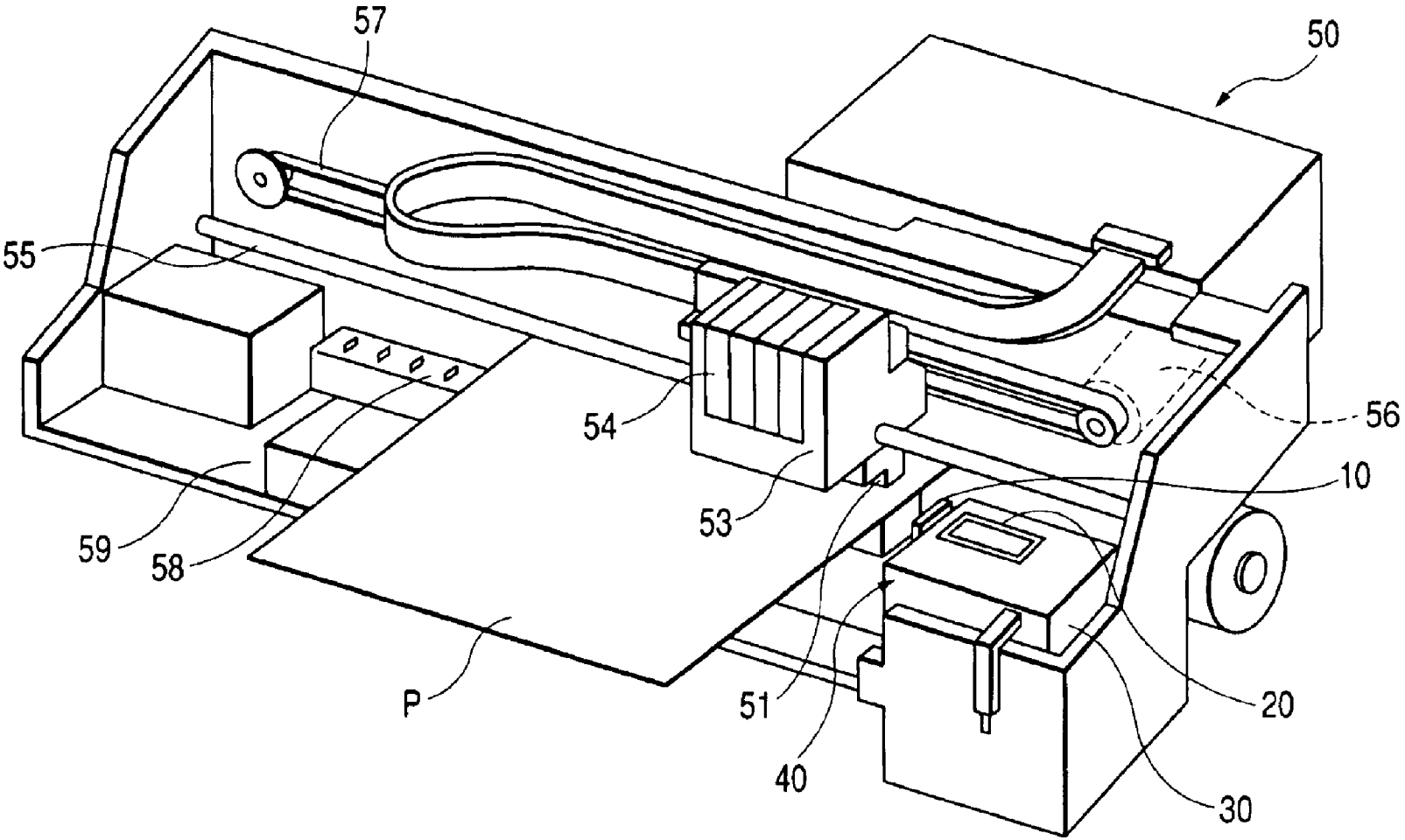
FIG. 1 is a perspective view showing an outline of an ink jet recording device.

FIG. 1 is a perspective view showing an outline of an ink jet printer 50 according to an embodiment of the present invention. For showing clearly the inner structure of the ink jet printer, the printer is illustrated in a state that a body cover is removed. A carriage 53 is reciprocatively moved in a main scan direction along a carriage guide shaft 55 by a timing belt 57 coupled to a driving motor 56. In this state, a recording head 51 ejects ink toward a recording medium P to thereby effect the recording. An ink cartridge 54 of different color inks of black, cyan, magenta and yellow may be installed to the carriage 53.

An ejection-characteristic maintaining device 40, which is for maintaining an ejection characteristic of the recording head 51, is located at a position corresponding to a home position of the carriage 53. The ejection-characteristic maintaining device 40 includes a wiping device 10, a capping device 20 and a suction device 30. When the carriage 53 is positioned at the home position, the ejection-characteristic maintaining device 40 performs a capping operation, a suction operation and a wiping operation, which are for cleaning the recording head 51 and maintaining an ejection characteristic of the recording head 51.

Figure 2:
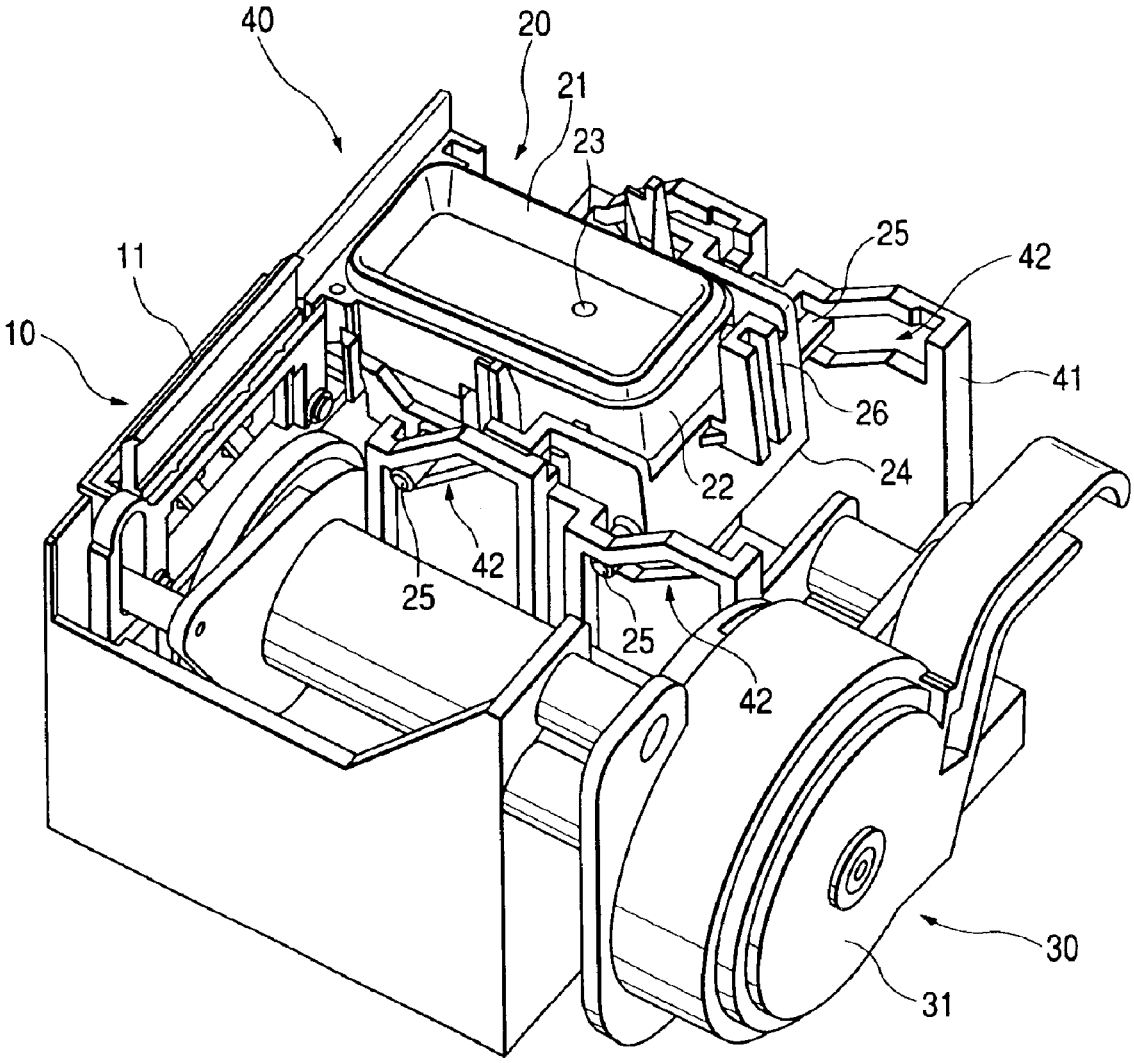
FIG. 2 is a perspective view showing a key portion of the FIG. 1 ink jet recording device and being useful in explaining an ejection-characteristic maintaining device constructed in a unit form.
Figure 3:
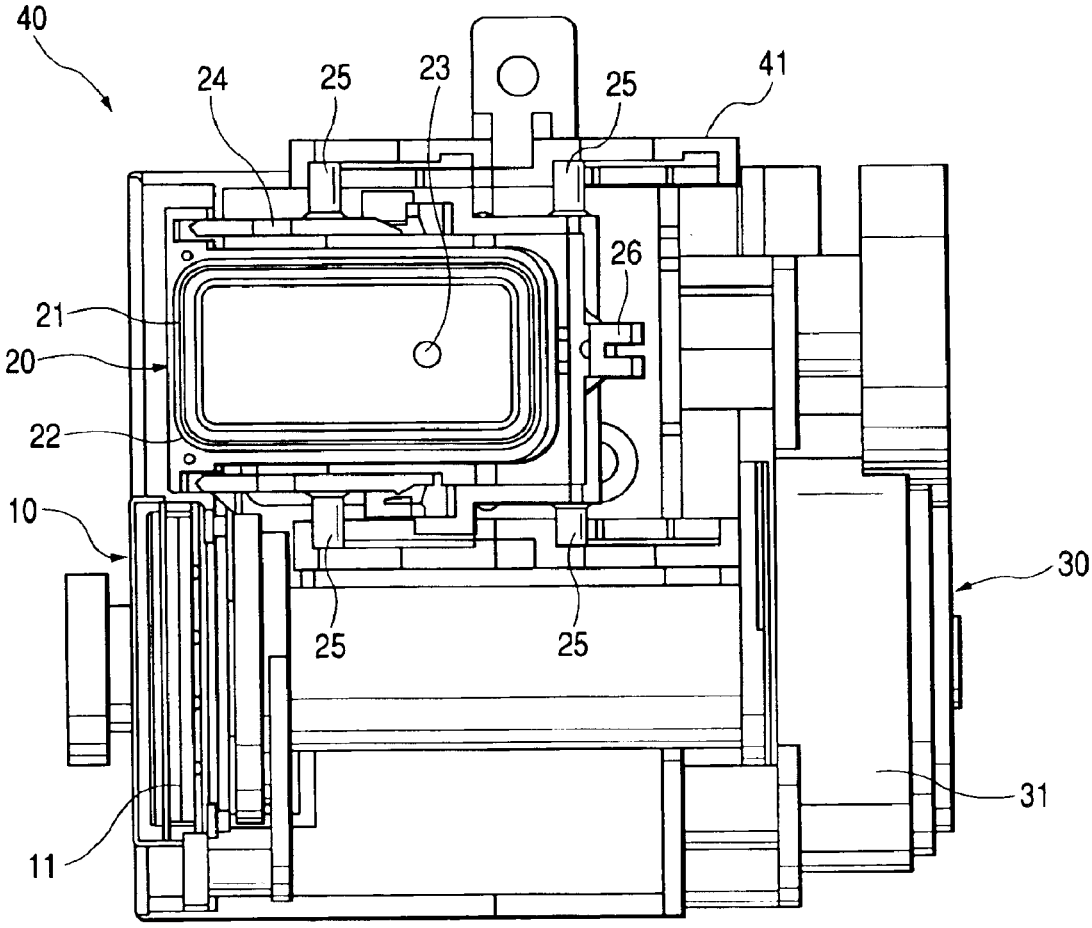
FIG. 3 is a plan view useful in explaining the unit-constructed ejection-characteristic maintaining device.

FIG. 2 is a perspective view showing the ejection-maintaining device 40 constructed in a unit form, and a plan view showing the same. The ejection-characteristic maintaining device 40 is constructed by assembling the wiping device 10, the capping device 20 and a tube pump 31 as the suction device 30 into one unit. The tube pump 31 is constructed such that a negative pressure is generated by sequentially crushing a flexible tube, arcuately disposed, by a roller, and a drive force of a sheet feeding motor (not shown) is utilized.

The capping device 20 includes a holder 22, and a cap member 21, made of an elastic material, such as rubber or elastomer, along a circumferential edge of an opening of the holder 22. The holder 22 and the cap member 21 are integrally formed by a two-color molding process, for example. A "volume of the cap member" is a volume of a recessed part defined by the holder 22 and the cap member 21. An ink discharging hole 23 is formed in the bottom of the holder 22. A suction-side tube of the tube pump 31 is connected to the ink discharging hole 23.

The holder 22 is mounted on a slider 24, which is provided with four guide members 25. A unit frame 41 for holding the slider 24 includes four slanted guide holes 42. The guide members 25 engage with the guide holes 42, respectively.

The slider 24 includes a protruded part 26 formed integrally with the slider. The protruded part 26, while being raised, extends to a moving path of a carriage 53, and comes in contact with an end of the carriage 53 when the carriage 53 moves to the home position. When the carriage 53 is moved to the home position, the protruded part 26 comes in contact with the end of the carriage 53, and is pushed to a moving direction of the carriage 53. By the pushing force of the carriage 53, the guide members 25 of the slider 24 slide in and along the slanted guide holes 42 of the unit frame 4 to upward. By the sliding movement, the cap member 21 integrally formed with the holder 22 approaches to the nozzle forming face of the recording head 51 mounted on the carriage 53 and seals the nozzle forming face. When the carriage 53 is moved to a printing region, the slider 24 moves to the printing region by an urging force of a spring (not shown), for example. With this, the sealing of the nozzle forming face of the recording head 51 by the cap member 21 is removed.

A cleaning operation is performed in the following way. The tube pump 31 is driven in a state that the cap member 21 seals the nozzle forming face of the recording head 51. A negative pressure is applied to the nozzle forming face of the recording head 51. Ink is sucked from the recording head 51 and forcibly discharged. After the ink suction, the carriage 53 is moved to the printing region to thereby remove the sealing of the nozzle forming face by the cap member 21. In this state, the tube pump 31 is driven, and then waste ink is discharged from the cap member 21 through the ink discharging hole 23 and transported into a waste ink tank 59 (FIG. 1) through the tube pump 31.

Figure 4A:
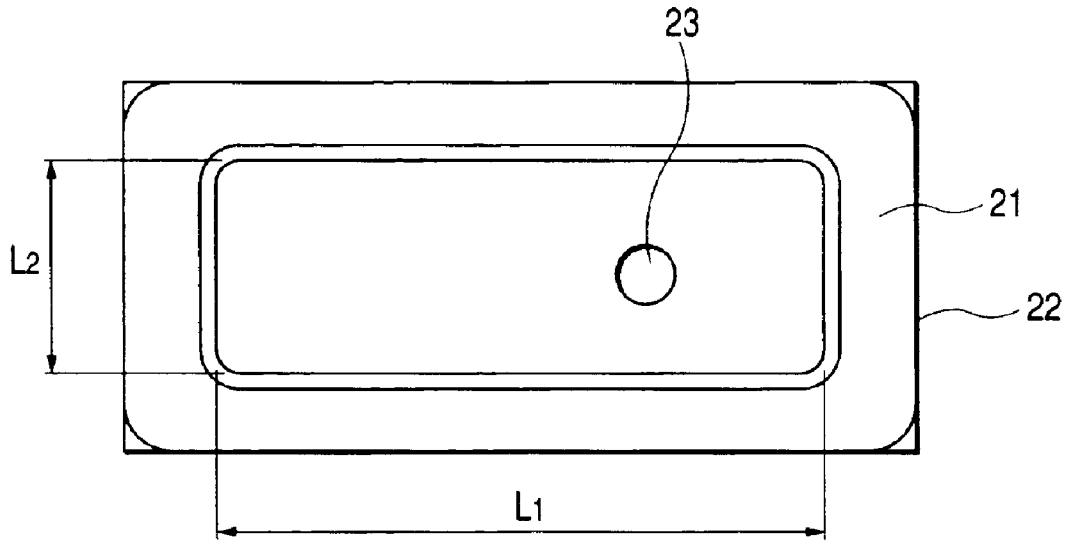
FIG. 4A is a plan view of the cap member and FIG. 4B is a cross sectional view showing the cap member.
Figure 4B:
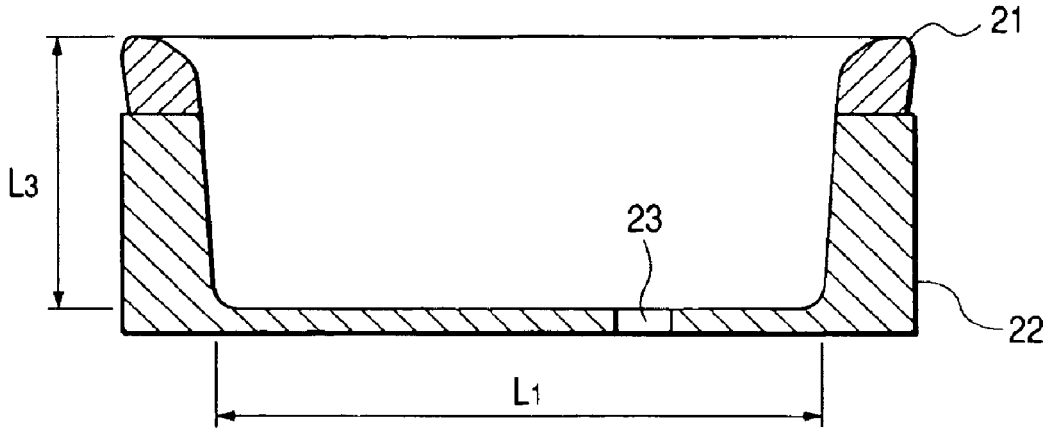

FIG. 4 shows an enlarged view showing the cap member 21 integral with the holder 22; FIG. 4A is a plan view of the cap member and FIG. 4B is a cross sectional view showing the cap member. A volume M of the cap member 21 is expressed approximately by $M=L_1 \times L_2 \times L_3$, where $L_1$ is a length of the cap member, $L_2$ is a width and $L_3$ is a height. In many cases, an inner space of the cap member 21 is not cubic in shape. Strictly, the volume M is somewhat different from an exact volume of the cap member. In this instance, however, it is assumed that the cap volume is expressed by the above equation, for simplicity. In the embodiment illustrated in FIG. 4, the cap member 21 is integral with the holder 22. Therefore, a total of a volume of the cap member 21 and that of the recessed part of the holder 22 is the "volume M of the cap member 21", as described above. If the recessed part consists of only the cap member 21, the volume M is determined by a length, width and height (depth) of the recessed part of the cap member 21.

Figure 5A:
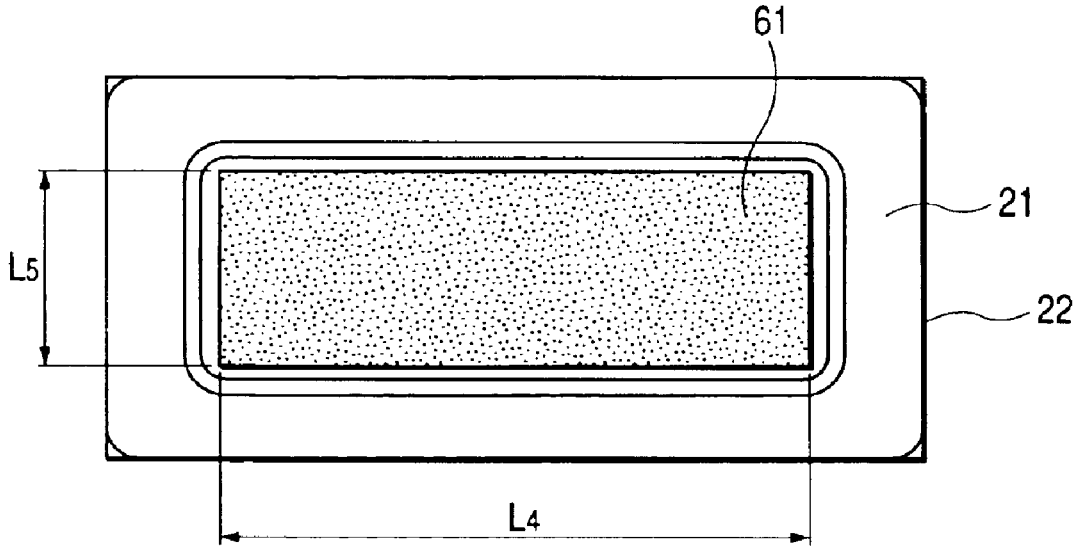
FIG. 5A is a plan view of the cap member and FIG. 5B is a cross sectional view of the same.
Figure 5B:
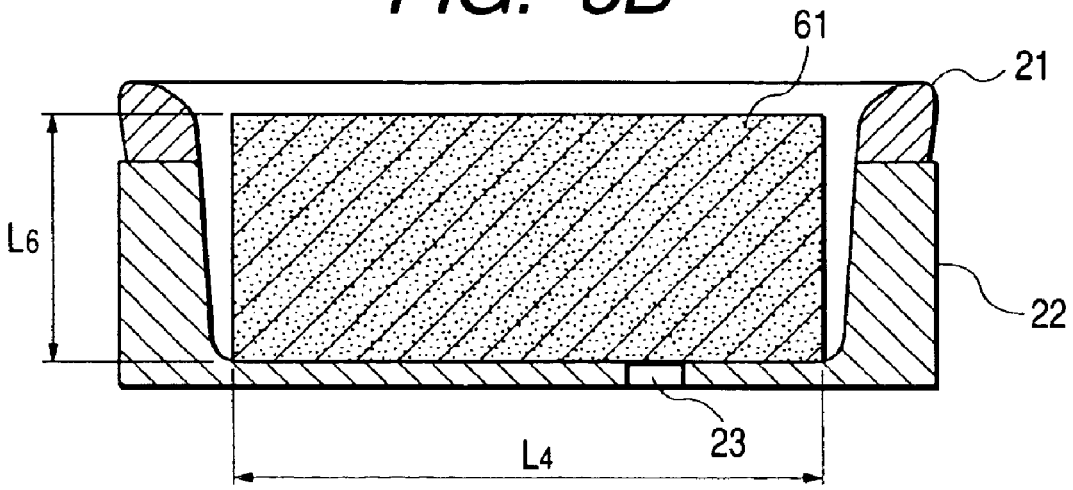

FIG. 5 shows a structure in which an ink absorbing member 61 is put in the cap member 21. The ink absorbing member 61 is formed such that a porous material made of polyvinyl alcohol, foamed urethane or the like, or a non-woven fabric of such a fiber as polyethylene terephthalate, is fixed to the cap member. By the ink absorbing member 61 put in the cap member, the waste ink is retained in the ink absorbing member 61. When the cap member is removed after the suction operation, ink is hard to drop out of the cap member. Bubbling of waste ink is also prevented. The ink absorbing member 61 appropriately retains ink. Accordingly, in a state that the nozzle forming face of the recording head 51 is sealed, drying of the nozzle is suppressed. At the time of flushing, generation of mist is suppressed, and the ink drainage at the idle suction operation is good.

As shown in FIG. 5, the ink absorbing member 61 is put in the ink absorbing member 61. An ink retaining capability of the ink absorbing member 61 varies depending on a material, and when it is polyvinyl alcohol, for example, the ink absorbing capability is about 80% of the volume of it. The ink absorbing member 61 is cubic in shape. An ink retaining capacity $M_A$ of the ink absorbing member 61 is approximately expressed as $M_A=L_4 \times L_5 \times L_6 \times C$ where $L_4$=length, $L_5$=width $L_6$=height (C=coefficient of the ink retaining capability, which varies depending on a material of the ink absorbing member 61.) The ink absorbing member 61, which is formed based on the shape of the interior of the cap member 21, does not always take an exact cubic shape. Strictly, the volume $M_A$ is somewhat different from an exact retaining volume of the cap member. In this instance, however, it is assumed that the retaining volume is expressed by the above equation, for simplicity.

The ink jet printer 50, as will be exemplarily described hereunder, has a plurality of cleaning modes with different ink suction quantities. The term "suction of ink" or "suction operation" as used in the specification does not include "fine quantity suction". The reason for this is that the "fine quantity suction" is a mere suction process which is carried out attendant to another suction operation during the cleaning operation. For the same reason, the "fine quantity suction" is not involved also in the following cleaning modes.

| Cleaning mode | Volume of suction ink |
|---|---|
| First cleaning mode (CL1) | 0.31 g |
| Second cleaning mode (CL2) | 1.2 g |
| Third cleaning mode (CL3) | 1.62 g |
| Fourth cleaning mode (CL4) | 3.1 g |
| TCL mode | 0.5 g |
| Replacement CL mode | 1.14 g |

Cleaning modes CL1 to CL4 are cleaning modes by manual cleaning, which are performed when the user selects a cleaning operation (FIG. 7 to be given later). The first cleaning mode CL1 is most frequently performed in the manual cleaning operation, and a quantity of suction ink is small. The first cleaning mode CL1 is first performed, and then, the cleaning modes CL2 to C14 are successively performed in this order in accordance with conditions of the ink jet recording apparatus (the number of cleaning operations, a printing quantity of feeding paper after the previous cleaning operation, and others). Accordingly, the fourth cleaning mode CL4 is not performed till the manual cleaning operations are successively performed several times. That is, the cleaning mode CL4 is infrequently performed when the proper ink ejection characteristic is not restored even after the cleaning modes CL1 to CL3 are performed, for example, when air bubbles enter the recording head 51. The ink suction quantity of the cleaning mode CL4 is the largest, and a suction rate is set at a large value. The TCL mode is a cleaning mode for an automatic cleaning operation. For example, when the apparatus power source is turned on after the ink jet recording apparatus is not used for a predetermined period, the TCL mode is automatically performed for the purpose of adjusting the ejection characteristic. The replacement cleaning mode is automatically performed when an ink cartridge is replaced with another one. In this case, a volume of suction ink corresponds to a total ink quantity of ink being stagnated in a region from an ink supplying needle of the carriage 53 to a nozzle orifice (meniscus forming face) of the recording head.

The cleaning modes (CL1 to CL4) of the manual cleaning that the ink jet recording apparatus of the invention has, will be described with reference to FIGS. 5 and 6.

Figure 6:
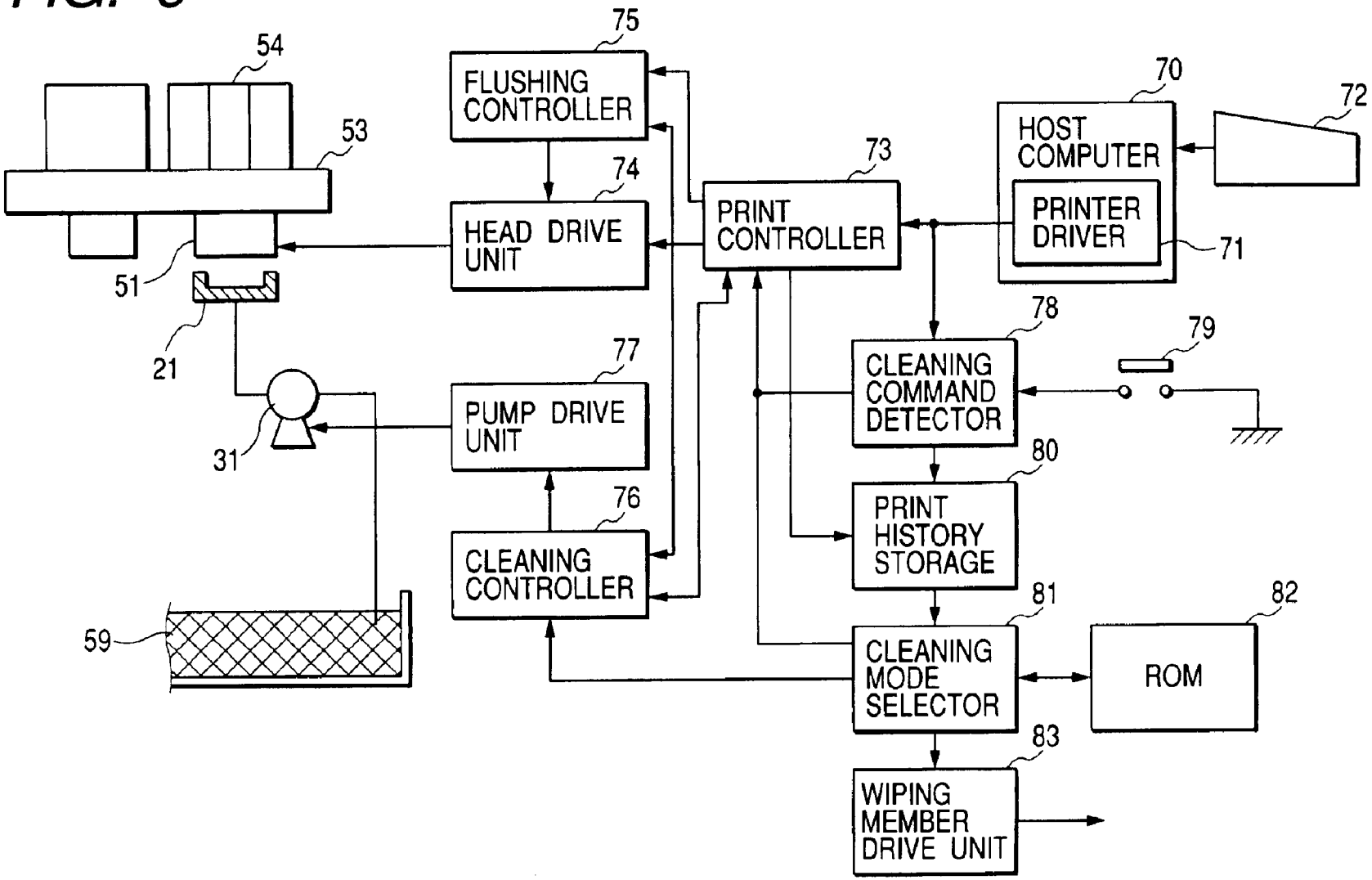
FIG. 6 is a block diagram showing an arrangement of a control circuit incorporated into the ink jet recording apparatus in FIG. 1.

FIG. 6 is a block diagram showing an arrangement of a control circuit incorporated into the ink jet recording apparatus 50. In FIG. 6, a host computer 70 contains a printer driver 71. Recording medium size, select of monochromatic printing or color printing, select of a recording mode, such data as font, print commands and the like are input from an input device 72 on the utility of the printer driver. Further, the host computer 70 executes a head cleaning operation in response to a cleaning command.

Responding to the inputting of a print command, the printer driver 71 sends print data to print controller 73. The print controller 73 generates bit map data based on the print data, a drive signal is generated by head drive unit 74, and ink is ejected from a recording head 51. In addition to the drive signal based on the print data, the head drive unit 74 receives a flushing command signal from flushing controller 75 to generate a drive signal for flushing operations for transfer to the recording head 51. Further, an idle discharging operation may be performed, which has no relation with the printing.

In response to a command issued form a cleaning controller 76, pump drive unit 77 operates and suction pump 31 is driven. A negative pressure is applied to the inner space of the cap member 21 in a state that the nozzle forming face of the recording head 51 is sealed, ink is sucked from the nozzle orifices of the recording head 51, and ink that is discharged into the cap member 21 is fed to the waste ink tank 59.

Cleaning command detector 78 receives a cleaning command, which is input on the utility of the printer driver 71, and cleaning operations to be described later are performed. The cleaning command detector 78 also responds to an operation of a cleaning command button 79, which is located on an operation panel of the recording device, for example, and cleaning operations to be described later are performed.

The cleaning command detector 78 sends a control signal to the print controller 73. When the cleaning command detector 78 receives a cleaning command as is input on the utility of the printer driver 71 or when it responds to an operation of the cleaning command button 79, the cleaning command detector 78 drives the print controller 73 and causes it to print a check pattern for checking a printing state.

The cleaning command detector 78 sends a control signal to print history storage 70. The print history storage 70 is reset to zero in its contents of print history at a time point where the head cleaning operation ends, and it obtains data from the print controller 73, and integrates and measures a printing quantity of feeding paper after the head cleaning operation. When the cleaning command detector 78 receives a cleaning command, a printing quantity of feeding paper after the previous printing operation is performed is extracted and the resultant data is supplied to cleaning mode selector 81 as judgment.

The cleaning mode selector 81 receives data representative of a printing quantity of feeding paper after the previous cleaning operation, for example, data representative of the number of print pages, and accesses a ROM 82, and determines a cleaning mode based on the data representative of the number of print pages. This determines whether or not an operation of sucking ink from the recording head is performed, and when the ink suction operation is performed, a control signal based a predetermined cleaning mode is sent to the cleaning controller 76.

FIG. 7 shows an operation sequence of a head cleaning control. The cleaning command detector 78 of the ink jet recording apparatus monitors whether or not a cleaning command is input by the operation of the user. When detecting the command inputting, it refers to a print history after the previous cleaning operation is performed, and it is judged whether or not five or more pages are printed after the previous cleaning operation is performed (S11). The judgment is made by referring to data representative of the number of print pages stored in the print history storage 70. If in the step S11, the number of print pages, which is printed after the previous cleaning operation is performed, is not five pages or smaller (NO), a step S12 is performed. In the step, a CL2 counter (to be described later) is defined to be KK=1. Then, a CL1 parameter read out of the ROM 82 is set in the cleaning mode selector 81 (step S13).

Subsequently, in a step S14, a before-cleaning judgment is made. Then, a step S15 is performed to redefine a TCL flag to "0", and then in a step S16, whether or not an error judgment is made in the before-cleaning judgment is determined. If the judgment is not an error judgment (NO), a step S17 is performed and the CL1 cleaning operation is performed. The cleaning mode CL1 is a cleaning mode having the least ink suction quantity.

In a case where the step S11 judges that a print quantity of feeding paper after the previous cleaning operation is performed is 5 pages or smaller (YES), the fact that the user inputs a cleaning command again indicates that the printing state is not yet returned to its normal printing state even though the previous cleaning operation is performed. Accordingly, the ink jet recording apparatus is set so as to execute a cleaning operation which is more powerful than the previous cleaning operation.

Specifically, in a step S18, a CL counter is detected. The number of manual cleaning operations is recorded in the CL counter. When a count of the CL counter is smaller than 4, a step S19 is performed. In the step S19, a CL2 counter is referred to. KK of the CL9 counter is a counter for causing the control to execute a select order in which the cleaning modes are selected in the following way, in a cleaning select operation. Specifically, when a value of the KK is "0" or "4", the KK is redefined to be 1 (KK=1), a CL1 parameter is set, and the cleaning mode CL1 is performed. To perform the next cleaning operation, the CL2 counter is redefined to be KK=2 since it was defined to be KK=1. Then, a CL2 parameter is set, and the cleaning mode CL9 is performed. Similarly, to perform another cleaning operation, the counter is redefined to be KK=3 since it was defined to be KK=2. Then, a CL3 parameter is set, and the cleaning mode CL3 is performed. Further, to perform an additional cleaning operation, the counter is redefined to be KK=4 since it was defined to be KK=3. Then, a CL4 parameter is set, and the cleaning mode CL4 is performed. Thus, as the cleaning operations are progressively performed in the order of CL1, CL2, CL3 and CL4, the suction quantity of ink becomes large and the cleaning operation becomes more powerful. In other words, the fact that the cleaning operations are successively performed implies that the printing state does not readily return to its normal state, and it is necessary to shift the cleaning operation to a more powerful cleaning operation. It is for this reason that the control is carried out as described above.

In the operation sequence in FIG. 7, in the step S19, the CL2 counter is referred to, and when KK=1, the CL2 counter is redefined to be KK=2 in a step S20, and a CL2 parameter is set in a step S21. Subsequently, as in the case of the cleaning mode CL1, the cleaning operation is performed in the cleaning mode CL2.

If the KK of the CL2 counter is 2 (KK=2) in the step S19, a step S22 is performed to judge whether or not a TCL flag is "1". If the TCL flag is not "1" (NO), a step S23 redefines the KK of the CL2 counter to be 3 (KK=3), and a step S24 sets a CL3 parameter. Subsequently, as in the case of the cleaning mode CL1, the cleaning operation is performed in the cleaning mode CL3.

Further, if the KK of the CL2 counter is 3 (KK=3) in the step S19, a step S25 is performed to redefine the KK of the CL2 counter to be 4 (KK=4). Then, a step S26 is performed to set the CL4 parameter, and a step S27 resets the CL counter to "0". Subsequently, as in the case of the cleaning mode CL1, the cleaning operation is performed in the cleaning mode CL4.

In a case where a count value of the CL counter is "4" or larger, a quantity of feeding paper after the previous cleaning operation is small and the user has repeatedly performed the cleaning operations. Accordingly, there is a high possibility that a trouble, such as air bubble entering, occurs. Accordingly, in this case, the control directly advances to the step S25 without referring to the CL2 counter. In this step, the CL2 counter is redefined to be KK=4. And in the step S26, the CL4 parameter is set, and the cleaning mode CL4 is performed.

The reason why the TCL flag is referred to in the step S22 follows. As already stated, the TCL mode is a cleaning mode which is automatically performed, for example, after non-use state of the apparatus continues for a fixed period. Accordingly, if the TCL flag is "1", a possibility that the apparatus is used after the non-use state is high, and there is a possibility that some trouble, such as increase of ink viscosity in the nozzles of the recording head 51, occurs. Accordingly, if TCL flag=1 in the step S22, the control directly advances to the step S25 with the intention of performing the cleaning more CL4, which is more powerful, without performing the cleaning operation of the CL3, although the number of cleaning operations is small (CL counter <4).

If the KK of the CL2 counter is 4 (KK=4) in the step S19, the control advances to the step S12, and the CL2 counter is redefined to be KK=1, the CL1 parameter is set, and the cleaning mode CL1 is performed. Where the KK of the CL2 counter is 4 (KK=4) in the step S19, the ink suction operation in the previous cleaning mode CL4 is already performed. Therefore, there is a possibility that a trouble occurs which cannot be solved even if the powerful suction operation is performed, or that the operation by the user was erroneous. In either case, the repeating of the execution of the cleaning mode CL4 in which an ink suction quantity is large results in a waste of ink. It is for this reason that the process of the step S19 is so carried out when KK=4.

A volume M of the cap member in the ink jet printer 50 of the invention is determined preferably by any of the following methods 1) to 3) on the basis of the suction operations mentioned above.

1) The volume of the cap member is determined on the basis of a suction ink volume (maximum ink suction quantity $CL_{max}$; CL4 in the above case) in the cleaning mode having the largest ink suction quantity, and is set at a value larger than the suction ink volume. 2) The volume of the cap member is determined on the basis of a suction ink volume in a cleaning mode other than the cleaning mode having the largest ink suction quantity (e.g., the cleaning mode having the second largest ink suction quantity; CL3 in the above case). 3) The volume of the cap member is determined on the basis of ½ (½$CL_{max}$) of the suction ink volume in the cleaning mode having the largest ink suction quantity.

4) An ink retaining capacity $M_A$ of the ink absorbing member 61 in the invention is determined on the basis of the maximum ink suction quantity $CL_{max}$, and is set at a value larger than the maximum ink suction quantity. 5) The ink retaining capacity is determined on the basis of the suction ink volume in a cleaning mode (for example, the cleaning mode having the second largest ink suction quantity) other than the cleaning mode having the largest ink suction quantity (CL3 in the above case).

6) ½ (½$CL_{max}$) of the suction ink volume in the cleaning mode having the largest ink suction quantity is preferably used as a base of determining the ink retaining capacity.

Let us first consider a case where the volume M of the cap member is determined on the basis of the ink suction quantity ($CL_{max}$) in the cleaning mode having the largest ink suction quantity. In the instance mentioned above, an ink suction quantity of the CL 4 is 3.1 g. Then, assuming that, for example, $L_1$ is 2.6 cm, $L_2$ is 1.0 cm, and $L_3$ is 1.2 cm in FIG. 4, then, M=3.12 $cm^3$. If $L_1$ to $L_3$ are selected to have values larger than those values just mentioned, the condition M≧CL4 is satisfied even if a specific gravity of ink is allowed for. If M≧$CL_{max}$ is thus satisfied, the cap member is prevented from being filled with waste ink at the time of ink suction operation. Further, the problem that the waste ink flows back into the nozzles, and the problem that the waste ink attaches to the nozzle forming face are surely solved. Let us then consider a case where the ink retaining capacity $M_A$ of the ink absorbing member 61 is determined on the basis of the maximum ink suction quantity $CL_{max}$. When a material of the ink absorbing member 61 is polyvinyl alcohol (C=0.8), assuming that, for example, $L_4$ is 2.6 cm, $L_5$ is 1.0 cm, and $L_6$ is 1.5 cm in FIG. 5, then, $M_A$=3.12 $cm^3$. If $L_4$ to $L_6$ are selected to have values larger than those values just mentioned, the condition $M_A \geqq CL4$ is satisfied even if a specific gravity of ink is allowed for. If $M_A \geqq CL_{max}$ is thus satisfied, the problem that the waste ink is absorbed from the cap member at the time of the suction operation, and the waste ink flows back into the nozzles, and the problem that the waste ink attaches to the nozzle forming face are surely solved. When $M \geqq CL4$ and $M_A \geqq CL4$, M and $M_A$ are selected preferably so as to satisfy $M \geqq M_A$.

Where the maximum ink suction quantity $CL_{max}$ (ink suction quantity in the cleaning mode CL4) is used as the base of determining the volume M of the cap member and (or) the ink retaining capacity $M_A$ of the ink absorbing member, reliability in the waste-ink back flow prevention and the like are improved, indeed, but the size of the cap member 21 must be increased to a certain extent. And, as seen from the operation sequence of FIG. 7, the operation mode having the maximum ink suction quantity $CL_{max}$ is the cleaning mode which is rarely executed. Allowing for the demand of size reduction of the cap member 21 (size reduction of the whole apparatus), it is more practical to design the cap member 21 to be appropriate in size for coping with the events which more frequently occur rather than to design the cap member 21 to be large in size for coping with the events which rarely occur.

The cleaning mode that is most frequently performed is the cleaning mode CL1, and the cleaning modes CL2 and CL3 are next to the cleaning mode CL1 in the frequency of their execution. Accordingly, it is preferable to determine the volume M of the cap member on the basis of the suction ink volume, for example, in the cleaning mode CL3 having the second largest ink suction quantity as the cleaning mode other than the cleaning mode having the largest ink suction quantity. In this case, the ink suction quantity in the cleaning mode CL3 is 1.62 g. Then, assuming that, for example, $L_1$ is 2.4 cm, $L_2$ is 1.0 cm, and $L_3$ is 0.7 cm in FIG. 4, then, M=1.68 $cm^3$. If $L_1$ to $L_3$ are selected to have values larger than those values just mentioned, the condition $M \geqq CL3$ is satisfied even if a specific gravity of ink is allowed for. When so set, the problems of waste-ink back flow, air bubble entering and others may be solved in relatively high level of solution in a manner that when the cleaning mode having the largest ink suction quantity is performed, the fine quantity suction which is conventionally used is also performed. The execution of the fine quantity suction will little create a problem even if the cleaning time is long because the execution frequency of the cleaning mode per se, which has the largest ink suction quantity, is extremely low. Accordingly, also when the ink retaining quantity $M_A$ of the ink absorbing member 61 is determined, similarly, the cleaning mode CL3, for example, which has the second largest ink suction quantity, is preferably used for the cleaning mode other than the cleaning mode having the largest ink suction quantity as the base of determining the ink retaining capacity. Assuming that, for example, $L_4$ is 2.4 cm, $L_5$ is 1.0 cm, and $L_6$ is 0.9 cm in FIG. 5, M=1.728 $cm^3$ when a material of the ink absorbing member 61 is polyvinyl alcohol (C=0.8). If $L_4$ to $L_6$ are selected to have values larger than those values just mentioned, the condition $M_A \geqq CL3$ is satisfied even if a specific gravity of ink is allowed for. Further, when $M \geqq CL3$ and $M_A \geqq CL3$, M and $M_A$ are selected preferably so as to satisfy $M \geqq M_A$.

The volume M of the cap member may be determined on the basis of ½ (½$CL_{max}$) of the suction ink volume in the cleaning mode having the largest ink suction quantity. In the ink jet recording apparatus having a plurality of cleaning modes which are different in a quantity of ink sucked in one suction operation, in many cases, an execution frequency of the cleaning mode having the largest ink suction quantity is usually set to be considerably lower than that of each of the remaining cleaning modes, and the ink suction quantity of each of the cleaning modes (CL1 to CL3) which are high in execution frequency is set to be, as its upper limit value, about ½ of the maximum suction quantity $CL_{max}$, as so also in the above instance. Accordingly, the cap member, if its size is determined on the basis of ½$CL_{max}$, can cover most of the cleaning operations. In the above instance, ½$CL_{max}$= 1.55. Then, assuming that, for example, $L_1$ is 2.5 cm, $L_2$ is 0.9 cm, and $L_3$ is 0.7 cm in FIG. 4, then, M=1.575 $cm^3$. If $L_1$ to $L_3$ are selected to have values larger than those values just mentioned, the condition $M \geqq ½CL_{max}$ is satisfied even if a specific gravity of ink is allowed for.

Accordingly, also when the ink retaining quantity $M_A$ of the ink absorbing member 61 is determined, similarly, it is preferable to use ½ of the suction ink volume (½$CL_{max}$) of the cleaning mode having the largest ink suction quantity as the base of determining the ink retaining capacity. In this case, ½$CL_{max}$=1.55. Then, assuming that, for example, $L_4$ is 2.5 cm, $L_5$ is 1 cm, and $L_6$ is 0.8 cm in FIG. 5, M=1.6 $cm^3$ when a material of the ink absorbing member 61 is polyvinyl alcohol (C=0.8). If $L_4$ to $L_6$ are selected to have values larger than those values just mentioned, the condition $M_A \geqq ½CL_{max}$ is satisfied even if a specific gravity of ink is allowed for. Further, when $M \geqq ½CL_{max}$ and $M_A \geqq ½CL_{max}$, M and $M_A$ are selected preferably so as to satisfy $M \geqq M_A$.

In the embodiment mentioned above, the volume M of the cap member is practically determined in consideration of the structure of the whole ink jet recording apparatus, the size of the recording head 51 and the like. In the case of 1) above (the maximum ink suction quantity $CL_{max}$ is used as the base of determining the volume of the cap member, and the volume is set to be larger than $CL_{max}$), it is preferable that the volume of the cap member is somewhat larger than the $CL_{max}$. In the case of 2) above (the volume of the cap member is determined on the basis of a suction ink volume in a cleaning mode other than the cleaning mode having the largest ink suction quantity, and is set to be larger the suction ink volume), the volume of the cap member is preferably $CL_{max}$ or smaller. Particularly, it is preferable that the volume of the cap member is somewhat larger than the suction ink volume in the cleaning mode CL3 having the second largest ink suction quantity. Also in the case of 3) (½$CL_{max}$ is used as the base of determining the volume of the cap member, and the volume is larger than ½$CL_{max}$), the volume of the cap member is preferably $CL_{max}$ or smaller. Particularly, it is preferable that the volume of the cap member is somewhat large than ½$CL_{max}$.

Similarly, the ink retaining capacity $M_A$ of the ink absorbing member is practically determined in consideration of the structure and size of the cap member and the like. In the case of 4) above ((½$CL_{max}$ is used as the base of determining the ink retaining capacity of the ink absorbing member, and the ink retaining capacity is larger than ½$CL_{max}$), it is preferable that the ink retaining capacity of the ink absorbing member is somewhat large than $CL_{max}$. In the case of 5) above (the ink retaining capacity of the ink absorbing member is determined on the basis of a suction ink volume in a cleaning mode other than the cleaning mode having the largest ink suction quantity, and is set to be larger the suction ink volume), the ink retaining capacity of the ink absorbing member is preferably $CL_{max}$ or smaller. Particularly, it is preferable that the volume of the cap member is somewhat larger than the suction ink volume in the cleaning mode CL3 having the second largest ink suction quantity. In the case of 6) above ($\frac{1}{2}CL_{max}$ is used as the base of determining the volume of the cap member, and the volume is larger than $\frac{1}{2}CL_{max}$), the volume of the cap member is preferably $CL_{max}$ or smaller. Particularly, it is preferable that the ink retaining capacity of the ink absorbing member is somewhat large than $\frac{1}{2}CL_{max}$. The volume M of the cap member and the ink retaining capacity $M_A$ of the ink absorbing member are preferably selected so as to satisfy $M \geqq M_A$.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid jetting apparatus comprising:

a liquid jetting head, ejecting a liquid droplet from a nozzle thereof;

a cap member, sealing a nozzle forming face of the liquid jetting head; and a suction device, applying a negative pressure to the nozzle forming face of the liquid jetting head in a state that the nozzle forming face is sealed with the cap member so that the liquid in the liquid jetting head is discharged, wherein:

the suction device performs a plurality of cleaning modes which are different in a quantity of suction liquid in one suction operation; and a volume of the cap member is equal to or greater than a suction liquid volume in a cleaning mode which has the second largest liquid suction quantity next to the largest cleaning mode having the largest liquid suction quantity.

2. A liquid jetting apparatus according to claim 1:

wherein:

a volume of the cap member is the suction liquid volume or larger in a cleaning mode having the largest liquid suction quantity.

3. The liquid jetting apparatus as set forth in claim 2, wherein:

a liquid absorbing member comprised of a porous material or a nonwoven fabric is provided on the cap member, and a liquid retaining capacity of the liquid absorbing member is a suction liquid volume or larger in a cleaning mode having the largest liquid suction quantity.

4. The liquid jetting apparatus as set forth in claim 1, wherein:

the liquid absorbing member comprised of a porous material or a nonwoven fabric is provided on the cap member, and a liquid retaining capacity of the liquid absorbing member is a suction liquid volume or larger in a cleaning mode other than a cleaning mode having the largest liquid suction quantity.

5. A method of designing a cap member for sealing a nozzle forming face of a liquid ejection head comprising;

calculating a volume of liquid sucked during one suction operation in a cleaning mode which has the second largest liquid suction quantity next to the largest liquid suction quantity among a plurality of cleaning modes which are different in a quantity of suction liquid in one suction operation; and designing the cap member which has a volume being equal to or greater than the calculated volume of the liquid sucked during the one suction operation in the cleaning mode, wherein a negative pressure is applied to the nozzle forming face in a state that the nozzle forming face is sealed with the cap member in the one suction operation.

6. A method of designing a cap member according to claim 5, further comprising:

calculating a volume of liquid sucked during one suction operation in a large cleaning mode having the largest liquid suction quantity among a plurality of cleaning modes which are different in a quantity of suction liquid in one suction operation; and designing the cap member which has a volume being equal to or greater than the calculated volume of the liquid sucked during the one suction operation in the large cleaning mode.

* * * * *